US011325400B2

(12) United States Patent
Yraceburu et al.

(10) Patent No.: US 11,325,400 B2
(45) Date of Patent: May 10, 2022

(54) CONTROL OF A HEATED SYSTEM TEMPERATURE

(71) Applicant: Hewlett-Packard Development Company, L.P., Spring, TX (US)

(72) Inventors: Robert Yraceburu, Vancouver, WA (US); Daniel James Magnusson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/047,976

(22) PCT Filed: Jul. 13, 2018

(86) PCT No.: PCT/US2018/042022
§ 371 (c)(1),
(2) Date: Oct. 15, 2020

(87) PCT Pub. No.: WO2020/013854
PCT Pub. Date: Jan. 16, 2020

(65) Prior Publication Data

US 2021/0114384 A1 Apr. 22, 2021

(51) Int. Cl.

| | |
|---|---|
| ***B41J 11/00*** | (2006.01) |
| ***B41M 7/00*** | (2006.01) |
| ***H05B 1/02*** | (2006.01) |

(52) U.S. Cl.
CPC ..... *B41J 11/00242* (2021.01); *B41J 11/0005* (2013.01); *B41M 7/009* (2013.01); *H05B 1/0241* (2013.01)

(58) Field of Classification Search
CPC ..... B41J 11/00242; B41M 7/009
See application file for complete search history.

(56) References Cited

U.S. PATENT DOCUMENTS

| | | | |
|---|---|---|---|
| 4,700,052 | A | 10/1987 | Wolf et al. |
| 4,791,435 | A | 12/1988 | Smith |

(Continued)

FOREIGN PATENT DOCUMENTS

| | | | |
|---|---|---|---|
| CN | 201196747 | Y | 2/2009 |
| JP | S63276563 | A | 11/1988 |
| JP | 2008122757 | | 5/2008 |

*Primary Examiner* — Matthew Luu
*Assistant Examiner* — Kendrick X Liu
(74) *Attorney, Agent, or Firm* — Dicke Billig & Czaja PLLC

(57) ABSTRACT

According to examples, a heated system may include a heat generating device, a temperature sensor to detect temperature in the heated system, and a controller. The controller may store temperatures detected by the temperature sensor over time and based on a determination that the temperature in the heated system has reached a predefined temperature value, stop application of power to the heat generating device. The controller may also calculate a rate of change of the stored temperatures corresponding to a predefined period of time prior to the application of power to the heat generating device being stopped, may determine a seeding value for a control mechanism of the heat generating device based on the calculated rate of change, and based on aa determination that a predefined condition has occurred, control the control mechanism to apply power to the heat generating device beginning with the determined seeding value.

14 Claims, 6 Drawing Sheets

(56) References Cited

U.S. PATENT DOCUMENTS

| | | | | |
|---|---|---|---|---|
| 5,365,257 | A | 11/1994 | Minowa | |
| 5,986,684 | A | 11/1999 | Ohashi | |
| 6,299,273 | B1 | 10/2001 | Anderson | |
| 7,057,141 | B1 | 6/2006 | Moy | |
| 7,349,642 | B2 | 3/2008 | Tatematsu et al. | |
| 7,379,685 | B2 | 5/2008 | Tatematsu et al. | |
| 8,150,289 | B2 | 4/2012 | Yamashina et al. | |
| 8,521,049 | B2 | 8/2013 | Chosokabe et al. | |
| 8,792,797 | B2 | 7/2014 | Ikebuchi et al. | |
| 9,221,056 | B2 | 12/2015 | Owen et al. | |
| 9,975,351 | B1 | 5/2018 | Luedeman | |
| 2005/0189343 | A1* | 9/2005 | Griffin | F02D 41/187 219/494 |
| 2007/0036570 | A1* | 2/2007 | Tatematsu | G03G 15/205 399/69 |
| 2009/0280428 | A1* | 11/2009 | Matsuo | G03G 15/2039 430/124.3 |
| 2009/0297199 | A1* | 12/2009 | Yamashina | G03G 15/2039 399/70 |
| 2012/0224878 | A1* | 9/2012 | Ikebuchi | G03G 15/2039 399/70 |
| 2015/0241831 | A1 | 8/2015 | Tanonaka | |
| 2017/0245551 | A1* | 8/2017 | Reevell | G01F 23/22 |
| 2018/0259886 | A1* | 9/2018 | Ajima | G03G 15/205 |

* cited by examiner

CONTROL OF A HEATED SYSTEM TEMPERATURE

BACKGROUND

Printing images or text on printable media in a printer includes various media processing activities, including pick-up, delivery to a print engine, printing, and conditioning of sheets of printable media. Conditioning may involve heating and pressing the sheets through or past a heated conveying component, such as a heated pressure roller (HPR), to remove liquid (for printers using liquid ink), to remove wrinkles or curvature, and/or to reform or flatten fibers in the sheets.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
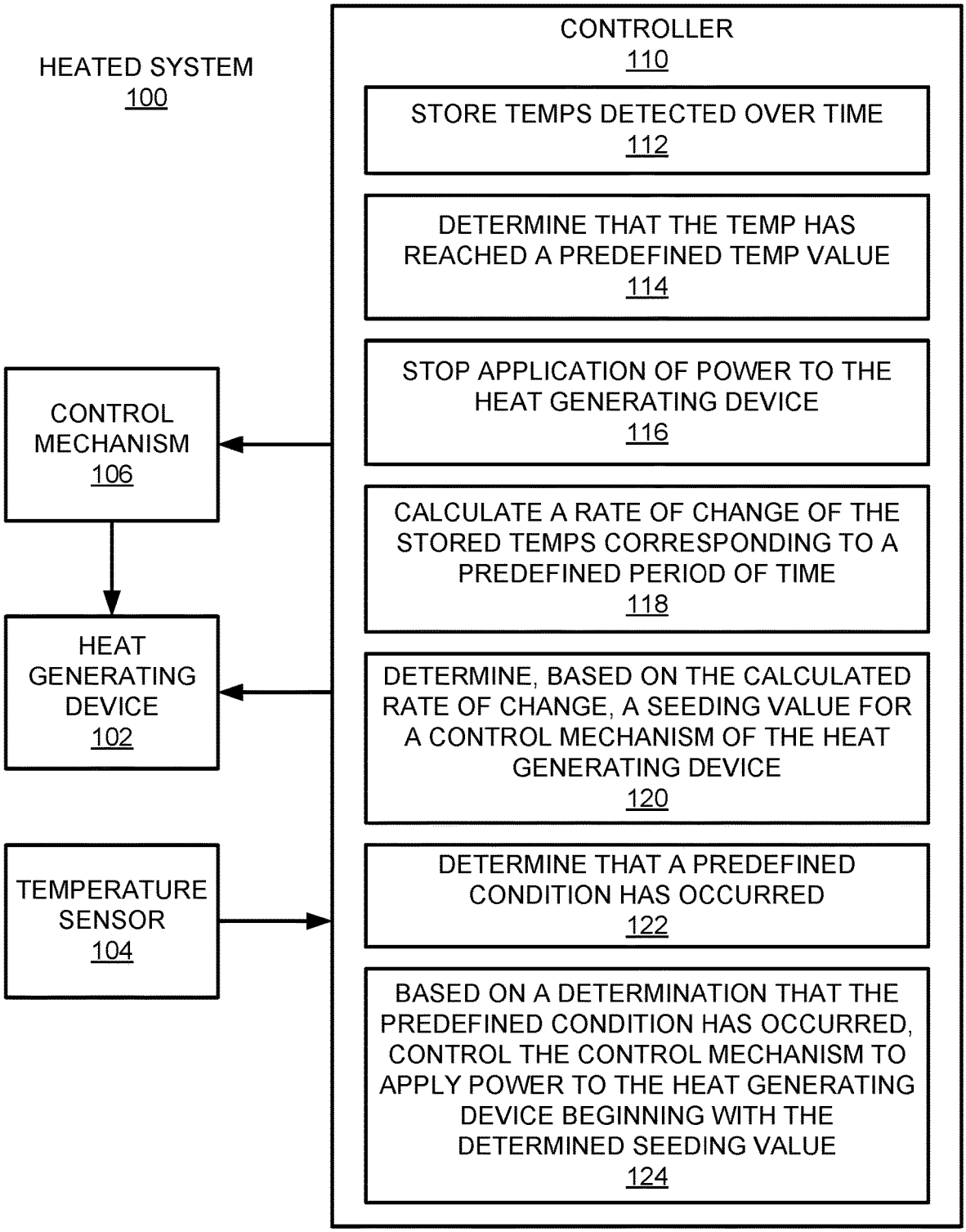
FIG. 1 depicts a block diagram of an example heated system including a controller that may control a heat generating device during both a ramping up period and a transition to a steady state temperature control operation.

For simplicity and illustrative purposes, the principles of the present disclosure are described by referring mainly to examples thereof. In the following description, numerous specific details are set forth in order to provide an understanding of the examples. It will be apparent, however, to one of ordinary skill in the art, that the examples may be practiced without limitation to these specific details. In some instances, well known methods and/or structures have not been described in detail so as not to unnecessarily obscure the description of the examples. Furthermore, the examples may be used together in various combinations.

Throughout the present disclosure, the terms "a" and "an" are intended to denote one of a particular element or multiple ones of the particular element. As used herein, the term "includes" means includes but not limited to, the term "including" means including but not limited to. The term "based on" may mean based in part on.

Many printers, such as inkjet printers, may include a heated system that may be used to help reduce media curl and ink smear, and provide better quality printed output in general. Examples of heated systems may include: dryers, fusers, pressure rollers, calendaring rollers, etc. In some examples, these heated systems may use heating elements and other components that may collectively consume a considerable amount of power during operation. A heated system may include a heat generating device that, when a media is to be conditioned, may be supplied with a maximum amount of available power to quickly ramp up the temperature in the heated system to a target temperature. By supplying the maximum amount of available power during the ramp up period, the temperature may be increased to the target temperature in a minimized length of time. Following the ramp up period, the temperature in the heated system may be maintained at or near the target temperature for a duration of a print job, e.g., during a steady-state operation period.

During ramp up at maximum power, some elements in a heated system may store a large amount of thermal energy. The stored thermal energy may increase the temperature in the heated system, which may cause the temperature in the heated system to be increased above, e.g., overshoot, the target temperature. The temperature overshoot may damage parts, trip thermal fuses/cutoffs, lead to media jams, lead to media damage, lead to poor page-to-page alignment in a finisher, etc.

Disclosed herein are heated systems, methods, and machine readable instructions that may control the temperature of a heated system during both a ramp up period and a steady-state period of the heated system that may prevent or minimize thermal overshoot caused by a heat generating device in the heated system. Particularly, a controller of a heated system disclosed herein may cause a full or high percentage of available power to be supplied to a heat generating device during the ramp up period and may cause a lower percentage of the available power to be supplied to the heat generating device during the steady-state period. To reduce or minimize thermal overshoot, the controller may stop the supply of power to the heat generating device prior to the temperature in the heated system reaching a setpoint (e.g., target) temperature of the heated system. That is, during the ramp up period, temperatures of the heated system may periodically be measured and stored until the temperature reaches a predefined temperature that is below the setpoint temperature for the heated system. The setpoint temperature may be a working temperature of the heated system, for example.

The heat generating device may continue to heat the heated system and thus, the temperature in the heated system may continue to rise following deactivation of the heat generating device. The predefined temperature may be based on the amount of temperature increase predicted or calculated to occur following deactivation of the heat generating device, e.g., following the ramp up period. In addition, the predefined temperature may be determined based on a rate of temperature change that occurred in the heated system during at least a portion of the ramp up period. The rate of temperature change may also be affected by the duration of time that has elapsed since a prior print job as discussed herein.

The controller disclosed herein may, following the deactivation of the heat generating device, calculate a rate of change of stored temperatures corresponding to a predefined period of time prior to the application of power to the heat generating device being stopped. In addition, based on the calculated rate, the controller may determine a seeding value for a control mechanism, e.g., a PID controller, or other feedback controller. The controller may further determine that a predefined condition has occurred following the application of power to the heat generating device being stopped. In addition, based on the determination that the predefined condition has occurred, the controller may control the control mechanism to apply power to the heat generating device beginning with the determined seeding value, e.g., as an initial pulse-width-modulation input value for the control mechanism. In other words, the controller may control the control mechanism to perform feedback control over the power supplied to the heat generating device to cause the heat generating device to maintain the temperature in the heated system at or near, e.g., within a predefined accuracy level, the setpoint temperature during a steady-state period.

According to examples, the control mechanism may not be used during the ramp up period because the control mechanism may significantly increase the ramp time and/or cause significant overshoot of the setpoint temperature. However, the control mechanism may be used during steady-state control to accurately maintain the temperature in the heated system at or near the setpoint temperature.

Through implementation of the heated systems, methods, and machine readable media disclosed herein, the seeding value for the control mechanism may be determined to cause the control mechanism to maintain the temperature in the heated system at or near the setpoint temperature at the beginning of the steady-state control period. That is, control mechanisms, e.g., PID controllers, often use a number of setting changes and detected feedback to vary the settings to achieve a desired result. By determining an accurate seeding value prior to initiating the feedback control, the control mechanism disclosed herein may cause the heat generating device to more quickly operate at a level that results in the temperature in the heated system to remain at or reach the setpoint temperature during the steady-state control period.

Figure 2:
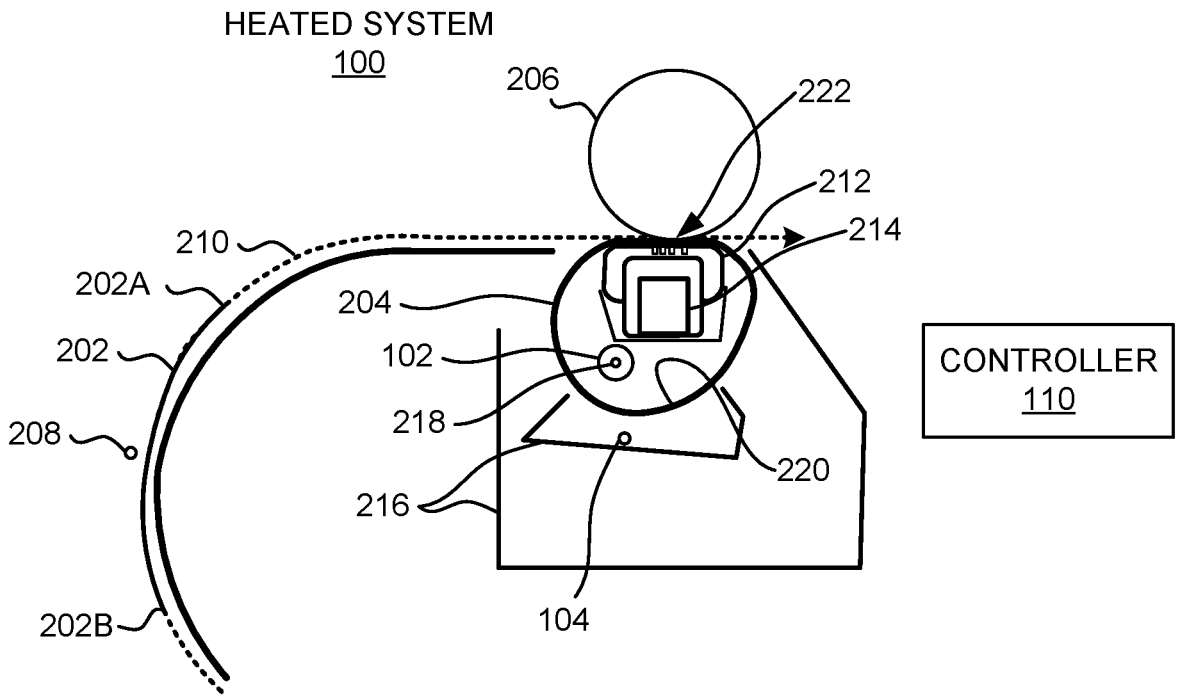
FIG. 2 shows a schematic diagram of the example heated system depicted in FIG. 1.

Reference is first made to FIGS. 1 and 2. FIG. 1 shows a block diagram of an example heated system 100 including a controller 110 that may control a heat generating device 102 during both a ramping up period and a transition to a steady state temperature control operation. FIG. 2 shows a schematic diagram of the example heated system 100 depicted in FIG. 1. It should be understood that the example heated system 100 depicted in FIGS. 1 and 2 may include additional features and that some of the features described herein may be removed and/or modified without departing from the scopes of the heated system 100. In addition, it should be understood that the example heated system 100 may have configurations other than the configuration shown in FIG. 2.

Generally speaking, the heated system 100 may be a system in which an object may be heated. According to examples, the heated system 100 may be part of a media printing system (not shown) in which the heated system 100 may condition, e.g., apply heat, to media upon which a printing substance, e.g., ink, toner, or the like, has been applied. That is, for instance, the heated system 100 may be positioned downstream of a print engine of the media printing system. In other examples, the heated system 100 may be implemented to condition other types of objects, e.g., 3D printed objects, painted objects, or the like.

As shown in FIGS. 1 and 2, the heated system 100 may include a heat generating device 102, a temperature sensor 104, a control mechanism 106 of the heat generating device 102, and a controller 110. The controller 110 may be a semiconductor-based microprocessor, a central processing unit (CPU), an application specific integrated circuit (ASIC), a field-programmable gate array (FPGA), and/or other suitable hardware device. Although the control mechanism 106 is depicted as being separate from the controller 110, in some examples, the control mechanism 106 may be integral with the controller 110. That is, for instance, the control mechanism 106 may be a feedback controller that the controller 110 may execute or implement.

The heated system 100 may include a first conveying component coupled to engage a second conveying component to receive, contact, heat, and convey a sheet of media 202. In this example, the first conveying component may be a heated belt 204 and the second conveying component may be a driven roller 206, which may be driven to rotate by a motor (not shown).

The heated system 100 may also include a media sensor 208 disposed along a media path 210, a platen 212, and a platen support structure 214 to support and guide the belt 204, and a chassis 216. In width, the belt 204, roller 206, platen 212 and the platen support structure 214 may extend "into the page" of FIG. 2. The media sensor 208 may sense and generate a signal in response to a sheet of printable media 202 being proximal the media sensor 208. The media 202 may be moving or may be stationary. In FIG. 2, the sheet of media 202 may be located on the media path 210 within the sensing range of the media sensor 208. The sheet of media 202 may include a leading edge 202A and a trailing edge 202B, named based on the intended direction of travel of the sheet of media 202. The leading edge 202A may be located beyond the media sensor 208, and the trailing edge 202B has not yet reached the media sensor 208. The media sensor 208 may detect the leading edge 202A, the trailing edge 202B, or the body of the sheet of media 202 between the edges 202A, 202B.

The heat generating device 102 may be a radiant heater, which may include a heating element 218. The heat generating device 102 may extend within the belt 204 to heat a heating zone 220 of the belt 204 by thermal radiation. The heating zone 220 may include the portions of the belt 204 that are in the field of view of the heat generating device 102 at any given moment in time. In various examples, the heated system 100 may include multiple heat generating devices 102, which may be designed and arranged to heat different portions of the belt 204. During operation, the roller 206 may conductively be heated by contact with the belt 204, and a length or a piece of media 202, when present, may be heated by contact with the belt 204 and the roller 206. In some examples, the heat generating device 102 may be disposed outside of the belt 204. The heat generating device 102 may be a halogen-type lamp, but other types of lamps or other types of heating elements may be used to heat the belt 204 and/or the roller 206.

The belt 204 and the roller 206 may contact and press against each other along a nip region 222 to receive and convey the media 202. The nip region 222 may extend along the shared width of the belt 204 and the roller 206. During operation, rotational movement of the roller 206 may drive the belt 204 to rotate by friction or by gearing, with or without media, in between the roller 206 and the belt 204. In addition, the temperature sensor 104 may monitor the temperature of the belt 204 to facilitate control by the controller 110 of the heat generating device 102. The temperature sensor 104 may be a non-contacting thermistor located outside and below the belt 204. Although a single temperature sensor 104 is depicted in FIG. 2, additional sensors may be disposed at different locations along the width of the belt 204. Other examples may include another form of non-contact temperature sensor or may include a contact temperature sensor located in another appropriate position.

The controller 110 may control the heat generating device 102 and the control mechanism 106 and may receive input from the temperature sensor 104. Particularly, for instance, the controller 110 may determine that the heated system 100 is to be implemented to apply heat to an object, for instance, a sheet of media 202. The controller 110 may make this determination based on receipt of an instruction from a processor in a printing device, based on receipt of a signal from the media sensor 208, or the like.

Based on the determination, the controller 110 may initiate supply of power to the heat generating device 102 at a first power level to thus cause the heat generating device 102 to be ramped up such that the heated system 100 reaches a setpoint temperature. In some examples, the controller 110 may supply power to the heat generating device 102 such that the temperature of the belt 204 reaches the setpoint temperature. In any regard, the setpoint temperature may be a desired temperature or other pre-established temperature value appropriate for achieving a desired heat transfer behavior in the heated system 100 to condition media 202 that passes through the heated system 100. The controller 110 may directly control the supply of power to the heat generating device 102, e.g., without implementing the control mechanism 106. As a result, for instance, the heat generating device 102 may be powered at the full power level until a desired temperature is reached.

According to examples, the first power level may be a full power level (e.g., a 100% power level, a maximum power level, or the like), to cause the heated system 100 to reach the setpoint temperature in a shortest length of time. As a result, a delay in conditioning the media 202 caused by heating up the heated system 100 may be minimized. In any regard, the controller 110 may continuously or at set periods of time receive temperature measurement readings from the temperature sensor 104 as the temperature in the heated system 100 changes.

As shown in FIG. 1, the controller 110 may store 112 temperatures detected by the temperature sensor 104 over time. That is, the controller 110 may receive the detected temperatures from the temperature sensor 104 and may store the received temperatures in a data store (not shown). The controller 110 may also track the received temperatures to determine 114 that the temperature in the heated system 100 has reached a predefined temperature value, which may occur as the heating device 102 is operated under the ramp up period. The controller 110 may also stop 116 application of power to the heat generating device 102 upon making a determination that a detected temperature in the heated system 100 has reached the predefined temperature. That is, based on the received temperature measurement readings from the temperature sensor 104, the controller 110 may determine that the detected temperature has reached the predefined temperature and may turn off the heat generating device 102. The predefined temperature may be a set temperature that is below the setpoint temperature of the heated system 100 (or the belt 204).

Figure 3:
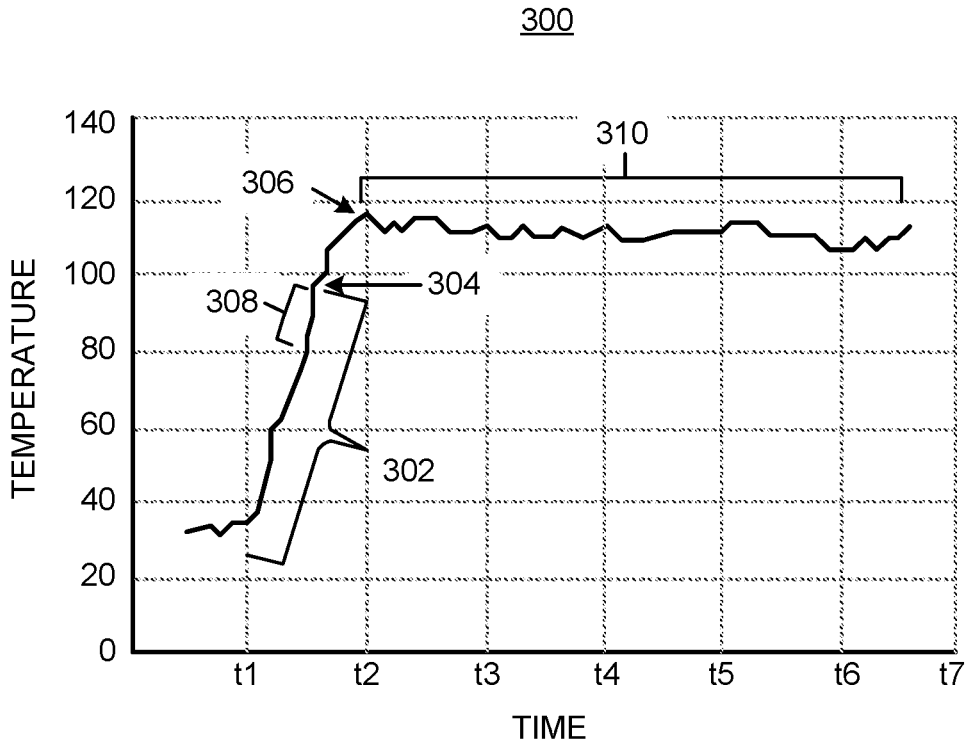
FIG. 3 shows an example graph of temperature vs time for the heated system depicted in FIG. 1.

To illustrate the features of FIGS. 1 and 2 according to an example, reference is made to FIG. 3, which shows an example graph 300 of temperature vs time for the heated system 100 depicted in FIG. 1. The graph 300 shows, for instance, the temperatures that the temperature sensor 104 may detect over a length of time during which the heated system 100 is active. As shown, the heat generating device 102 may have been activated at a time prior to time t1 and thus, the temperature in the heated system 100 may begin to increase from, for instance, an ambient temperature. In addition, power may be applied at the first power level as the temperature is ramped up as denoted by the section 302 in the graph 300. Power to the heat generating device 102 may continue to be delivered until the temperature is detected to have reached the predefined temperature value 304.

Due, for instance, to the configuration and the components of the heat generating device 102, the heat generating device 102 may continue to transfer heat for a period of time after the heat generating device 102 has been turned off. As a result, should the heat generating device 102 be powered on until the setpoint temperature 306 has been reached, the temperature in the heated system 100 may likely overshoot the setpoint temperature 306. Such overshooting may cause damage to components in the heated system 100. According to examples, the controller 110 may turn off the heat generating device 102 at the predefined temperature value 304 below the setpoint temperature 306, in which the predefined temperature value 304 may be defined based upon the amount of additional heating predicted to occur in the heated system 100 following the heat generating device 102 being turned off. The predefined temperature value 304 may be determined through empirical testing, through modeling, or the like, and may thus vary for different types of heated systems. By way of particular example, however, the predefined temperature may be between about 5° C. and about 15° C. below the setpoint temperature, although other temperatures may be implemented.

The controller 110 may calculate 118 a rate of change of the stored temperatures corresponding to a predefined period of time 308 prior to the application of power to the heat generating device 102 being stopped. That is, the controller 110 may store the detected temperatures (T) received from the temperature sensor 104 along with the times (t) at which the temperatures were detected or received and may calculate the rate of temperature change (dT/dt) from the stored temperatures and times. Particularly, the controller 110 may calculate the rate of temperature change for the predefined period of time 308, e.g., about 2 seconds, about 3 seconds, or the like, prior to the point in time at which the temperature in the heated system 100 was detected to have reached the predefined temperature value 304. In addition, the controller 110 may calculate the rate of temperature change through any suitable calculation method, such as, calculating an average of each of the dT/dt's over the certain period of time 308, calculating the rate of temperature change from a first temperature and time and a last temperature and time in the certain period of time 308, calculating the rate of temperature change as a slope of a line fit through the temperature measurements over the range of a predefined time, or the like.

Generally speaking, the rate of temperature change (dT/dt) in the heated system 100 may vary depending upon an initial temperature of the heated system 100 prior to the heat generating device 102 being supplied with the first power level. The initial temperature of the heated system 100 may be the ambient temperature, some temperature above the ambient temperature, or some temperature below the ambient temperature if the heated system 100 was recently moved from a cooler environment. If the heated system 100 has been idle for a sufficiently long period of time, the initial temperature will be at or near the ambient temperature. If the heated system 100 has performed a job relatively recently, the initial temperature may be somewhere between the ambient temperature and the setpoint temperature 306. The initial temperature may be affected by the length of time that has elapsed from when the heated system 100 was last implemented. That is, when heated, the components in the heated system 100 may retain some of the heat and thus, the heated system 100 may remain at a higher temperature following activation of the heat generating device 102 and may begin to cool thereafter.

Application of the first level of power begins a ramp-up phase of operation, e.g., from around t1 to around t1.6 in FIG. 3. The temperature in the heated system 100 ramps up towards the setpoint temperature 306. The ramp-up phase may end when the temperature reaches the predefined temperature value 304, e.g., when application of power at the first level to the heat generating device 102 is stopped.

The heated system 100 has a thermal mass (the ability of matter to absorb and store heat energy), which may affect the rate of temperature change in the heated system 100 produced by the heat generating device 102. In some examples, the heat generating device 102 may not be a closed system, but instead may include a vent and a fan that expels some air from the interior of the heated system 100 and pulls in some fresh, ambient air. The higher the fan speed, the more air that is expelled, and the more ambient air that comes into the heated system 100. As the air that is expelled is heated air, more heat energy is lost from the heated system 100 at higher fan speeds than at lower fan speeds. This may also affect the rate of temperature change, causing the temperature to rise slower at a higher fan speed.

Another factor that may affect the rate of temperature change may be the initial temperature of the heated system 100, the time when the ramp-up phase begins. The rate of temperature change during the period of time 308 is negatively proportional to a difference between the setpoint temperature 306 and a lower temperature of the heated system 100 at the time full power is applied to the heat generating device 102. In other words, the greater the difference between the setpoint temperature and a lower temperature of the heated system 100 at the time full power is applied to the heat generating device 102, the slower the rate of temperature change during the period of time 308.

When the heated system 100 is first started after the heated system 100 has been idle for a length of time, the components in the heated system 100 may be at ambient temperature. As heat is applied by the heat generating device 102, the components inside and around the heated system 100 may absorb a portion of the heat energy from the air. This may slow down the rate at which the air temperature rises (i.e., the rate of temperature change), which, as discussed herein, may be used to determine the seeding value for use by the control mechanism 106. The heat generating device 102 heats up and starts heating the air and other components around it, but the air gives up energy into the surrounding components. This accounts, at least in part, for why the slope is shallower when heating from near ambient in temperature as compared to heating from nearer the setpoint temperature 306.

Every time a job is completed, some amount of heat energy may be stored in the heated system 100. As more jobs are performed in a specified/given time period, e.g., a day, part of a day, etc., the heated system 100 may accumulate more energy (heat) that is stored in the system, which means that less energy (i.e., a lower duty cycle) may be employed to achieve the same setpoint temperature 306. As the delta temperature between the heated air and surrounding materials is lessened over time, the heat transfer into the surrounding materials slows down, and the rate of temperature change (dT/dt slope) increases. This is due, at least in part, because the heat energy transfer rate is proportional to the temperature difference between two objects—in this case, the heated system 100 and/or its air, and the surrounding components and materials.

The controller 110 may determine 120, based on the calculated rate of change, a seeding value for the control mechanism 106 of the heat generating device 102. The seeding value may be an initial value that may be applied to the control mechanism 106 to maintain the temperature in the heated system 100 and/or the belt 204 at or near the setpoint temperature 306. That is, for instance, the control mechanism 106 may use the seeding value to control the amount of power initially supplied to the heat generating device 102 following the heat generating device 102 being turned off. The seeding value may thus be a value that corresponds to the amount of heat that the heat generating device 102 generates when first activated by the control mechanism 106.

Figure 4:
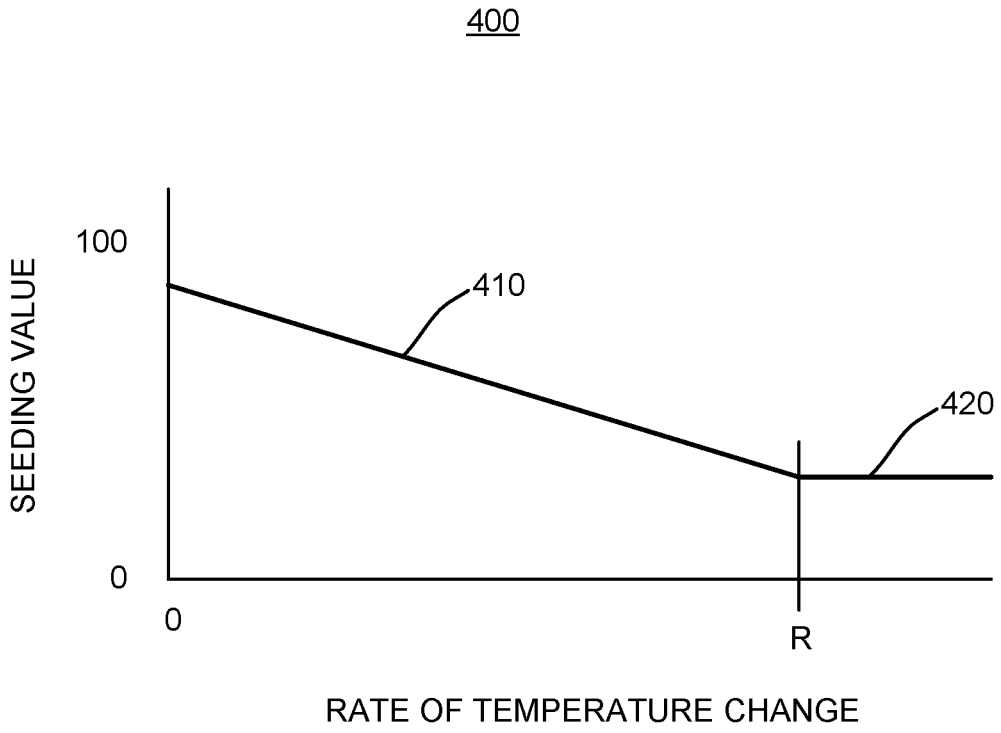
FIG. 4 shows an example piecewise-continuous function associated with a setpoint temperature that may convert the rate of temperature change into the seeding value.

The controller 110 may determine the seeding value, which may also be a pulse-width modulation (PWM) seeding value, based on the calculated rate of temperature change. Reference is made to FIG. 4, which shows an example piecewise-continuous function associated with a setpoint temperature 306 that may convert the rate of temperature change into the seeding value, e.g., the initial duty cycle. In one example of a piecewise-continuous function, graphically illustrated as curve 400, the seeding value may be negatively proportional to the rate of temperature change below a given rate R in a segment 410, and constant above the given rate R in a segment 420.

In one example, the piecewise-continuous function may be determined empirically by heating the heated system 100 from an initial temperature to a given setpoint temperature, recording the rate of temperature change at the point where the setpoint temperature is met or exceeded, and recording the duty cycle that kept the heated system 100 temperature at the setpoint temperature. This yields an x-y data point (initial duty cycle for a particular rate of temperature change). By varying, for a given setpoint temperature, the initial heated system 100 temperature, the speed of the dryer fan, and the line voltage in different combinations over a number of heating cycles, a number of x-y data points usable to construct the function for a particular setpoint temperature may be obtained, which may cover the range of initial heated system 100 temperatures, fan speeds, line voltages, and the like.

Curve fitting may then be used to empirically define the function. First, a lower limit for the initial duty cycle may be identified. It may be undesirable for the initial duty cycle to have too low a value or to be turned off (duty cycle=0%). In some examples, this is because although the heated system 100 may store heat very well, it is not 100% efficient. During the time the heated system 100 is commanded to maintain a target temperature above ambient, some heat losses will occur in the heated system 100 and thus heat energy will have to be input to the heated system 100 to keep it at the target temperature. This limit may define segment 420 and rate R. Curve fitting may then be applied to the remaining x-y data points. While segment 410 shown in the curve 400 corresponds to a linear function, in other examples the function may be non-linear.

The resulting function thus specifies higher seeding values for lower rates of temperature change where less heat is retained in the heated system 100, and lower seeding values for higher rates of temperature change where more heat is retained in the heated system 100. In some examples, the function may be used to calculate the seeding value from the rate of temperature change. In other examples, the function may be converted to a lookup table and the rate of temperature change may be used to look up the corresponding seeding value in the table.

By way of particular non-limiting example, the model may be, for a 110° C. setpoint temperature in which the heat generating device 102 is a halogen lamp:

If $0 \leq dT/dt < 15$, then seeding value$=-2.43*(dT/dt)+50.5$; or

If $dT/dt \geq 15$, then seeding value=14.

As another particular non-limiting example, the model may be, for an 80° C. setpoint temperature in which the heat generating device 102 is a halogen lamp:

If $0 \leq dT/dt < 15$, then seeding value=0.064*(dT/dt)^2−2.45*(dT/dt)+34.0; or If $dT/dt \geq 15$, then seeding value=11.

The control mechanism 106 may control the operation of the heat generating device 102 over a length of time 310, e.g., may control the amount of power delivered to the heat generating device 102 after the temperature in the heated system 100 has reached or nearly reached the setpoint temperature 306. That is, the control mechanism 106 may vary the heat output from the heat generating device 102 as temperature in the heated system 100 fluctuates over the period of time 310. The temperature in the heated system 100 may fluctuate over time based on, for instance, retention and/or dissipation of heat by components in the heated system 100, which may vary depending upon the length of time between heating jobs performed in the heated system 100 or sheets of media passing through the heated system 100.

According to examples, the control mechanism 106 may be a PID controller (proportional-integral-derivative control loop feedback mechanism) or other feedback controller that may receive detected temperatures from the temperature sensor 104 and may continuously vary the power output to the heat generating device 102 based upon the received temperatures to maintain the temperature in the heated system 100 around the setpoint temperature. That is, the control mechanism 106 may control the power delivery to the heat generating device 102 to maintain the temperature in the heated system 100 within a predefined accuracy based on detected temperatures in the heated system 100.

In other words, after the initial seeding value has been applied to the control mechanism 106, the control mechanism 106 may perform feedback control of the heat generating device 102 to maintain the temperature of the heated system 100 at or near the setpoint temperature 306 within a predefined accuracy. The control mechanism 106 may receive temperature measurements from the temperature sensor 104. During feedback (e.g., PID) control, and after applying the initial seeding value to the heat generating device 102, the heat generating device 102 duty cycle applied to the heating element 218 of the heat generating device 102 may change no more frequently than every one second, so as to keep the amount of flicker within acceptable limits.

In some examples, the heat generating device 102 may consume a sufficiently large amount of power such that, to keep flicker within acceptable limits, the duty cycle applied to the heating element 218 of the heat generating device 102 may be changed no more frequently than every six seconds. In one such example, the predefined accuracy for the setpoint temperature 306 may be less than or equal to between about +/−5 degrees C. and about +/−16% of the setpoint temperature 306. In another such example, the predefined accuracy for the setpoint temperature may be less than or equal to about +/−1 degrees C. and about +/−3% of the setpoint temperature 306.

According to examples, the controller 110 may use the rate of temperature change to determine the seeding value, e.g., the initial value to be applied to the heat generating device 102 by the control mechanism 106, which may maintain the temperature at or near the setpoint temperature 306 in the heated system 100, e.g., within a predefined accuracy. The control mechanism 106 control phase may begin following occurrence of a predefined condition as discussed herein with the application to the heat generating device 102 of the seeding value. Thus, the control mechanism 106 control phase may not occur immediately following the stoppage of power delivered to the heat generating device 102 at the first power level, e.g., full power level.

The seeding value may be the value applied to the control mechanism 106 to maintain the temperature in the heated system 100 at or near the setpoint temperature 306. By way of particular example, a second seeding value (e.g., an initial integral error term that gets preloaded to the PID control loop) may be calculated based on a first seeding value and the rate of temperature change, according to the formula:

$$IIET=(IHDC-(Kp*Et)-(Kd*Ed))/Ki$$

where

IIET=initial integral error term

IHDC=initial heater duty cycle

Kp=proportional term gain constant (based on system characteristics)

Kd=derivative term gain constant (based on system characteristics)

Ki=integral term gain constant (based on system characteristics)

Et=temperature error (=target temperature−dryer temperature)

Ed=temperature derivative error (=rate of temperature change)

If execution of the PID control loop were to be started without providing the initial integral error term, a significant amount of undesirable temperature sag or overshoot may occur as the PID control loop constructs its own error term from scratch. If the initial integral error term applied by the PID control loop is too low, the heat generating device 102 temperature may sag and the PID control loop may calculate larger error terms and, thus, a larger resultant heat generating device 102 duty cycle. However, until the PID control can react, the heat generating device 102 temperature may sag. Conversely, if the initial integral error term applied is too high for the amount of heat already stored in the heat generating device 102 components, the heat generating device 102 temperature may overshoot the setpoint temperature 306 until the PID controller can adjust, which may take time since the nature of PID control relies on the error terms that are periodically calculated.

A minimum time delay between changes in the value of the heat generating device 102 duty cycle may be enforced during PID control. The time delay between changes in duty cycle, which may be enforced by the PID control loop or the power electronics of the heat generating device 102, may exacerbate the sag and/or overshoot because the PID control loop may be constrained from responding more rapidly to changes in the heat generating device 102 temperature. In one example, where the setpoint temperature 306 is +30 degrees C. above ambient and the time delay is 6.1 seconds, the temperature sag/overshoot could be as much as +/−25% if the integral error term is not pre-loaded. However, by supplying the initial heat generating device 102 duty cycle and the integral error term to the PID control loop, the temperature sag/overshoot may be reduced to +/−7% or less.

The controller 110 may determine 122 that a predefined condition has occurred at some time following the heat generating device 102 being turned off, e.g., following the stoppage of power flow to the heat generating device when the detected temperature has reached the predefined temperature value 304. The occurrence of the predefined condition may trigger the control mechanism 106 to initiate the supply of power to the heat generating device 102 at the determined seeding value. The predefined condition may be, for instance, an expiration of a maximum wait time. The maximum wait time may be a user-defined period of time following the stoppage of the application of power to the heat generating device 116 based on the temperature reaching the predefined temperature value 304. In some examples, the maximum wait time may be a function of the calculated rate of change (dT/dt). Thus, for instance, the maximum wait time may be higher for a rate of change that is higher than for a rate of change that is lower.

In addition, or in other examples, the predefined condition may be a rate of temperature change going negative prior to the temperature reaching the setpoint temperature 306. That is, for instance, the controller 110 may determine that the predefined condition has occurred when the dT/dt is determined to be negative as may occur when the heat generating device 102 stops generating heat. In these examples, the controller 110 may control the control mechanism 106 to initiate power supply to the heat generating device 102 to bring the temperature in the heated system 100 to near the setpoint temperature 306. In addition, or in further examples, the predefined condition may be a current detected temperature exceeding the setpoint temperature and following the rate of temperature change (dT/dt) going negative and/or the temperature falling below a threshold temperature. In some examples, the controller 110 may determine that the predefined condition has occurred when any of the above-identified conditions occurs.

The controller 110 may, based on the determination that the predefined condition has occurred, control 124 the control mechanism 106 to apply power to the heat generating device 102 beginning with the determined seeding value. The control mechanism 106 may control delivery of power to the heat generating device 102 to vary the amount of heat generated and thus, may maintain the temperature in the heated system 100 within a desired temperature range. As discussed herein, the control mechanism 106 may be a PID controller or another type of controller.

In examples, the control mechanism 106 may output power level signals, which may be pulse-width-modulated (PWM) signals. Whether the control mechanism 106 uses a PWM signal, another analog power level signal, or a digital power level signal, the signal may vary incrementally or smoothly from zero to 100%. The value of 100% power refers to the maximum power that the heating element 218 may accept or the maximum power that the heated system 100 may provide. Broadly, the term "power level" may refer to electrical power that is to be made available to the heating element 218 or that is used by the heating element 218, or it may refer to the power level signal for controlling the electrical power to the heating element 218. Although the control mechanism 106 and the controller 110 are depicted as being directly connected to the heat generating device 102, electrical couplings may connect the controller 110 (and the control mechanism 106) to a power supply that feeds the heat generating device 102.

According to examples, the operations 112-124 may be machine readable instructions stored on a memory (not shown) that the controller 110 may execute. The memory may be an electronic, magnetic, optical, or other physical storage device that contains or stores executable instructions. The memory may be, for example, Random Access memory (RAM), an Electrically Erasable Programmable Read-Only Memory (EEPROM), a storage device, an optical disc, and the like. The memory may also be referred to as a non-transitory machine readable medium, where the term "non-transitory" does not encompass transitory propagating signals.

In addition or in other examples, the operations 112-124 may be stored in hardware logic blocks. In other examples, the operations 112-124 may be embodied by a combination of machine readable instructions and hardware logic blocks. In any of these examples, the controller 110 may implement the hardware logic blocks and/or execute the operations 112-124. The controller 110 may include additional machine readable instructions and/or hardware logic blocks such that the controller 110 may execute operations in addition to or in place of those discussed above with respect to FIG. 1.

Figure 5:
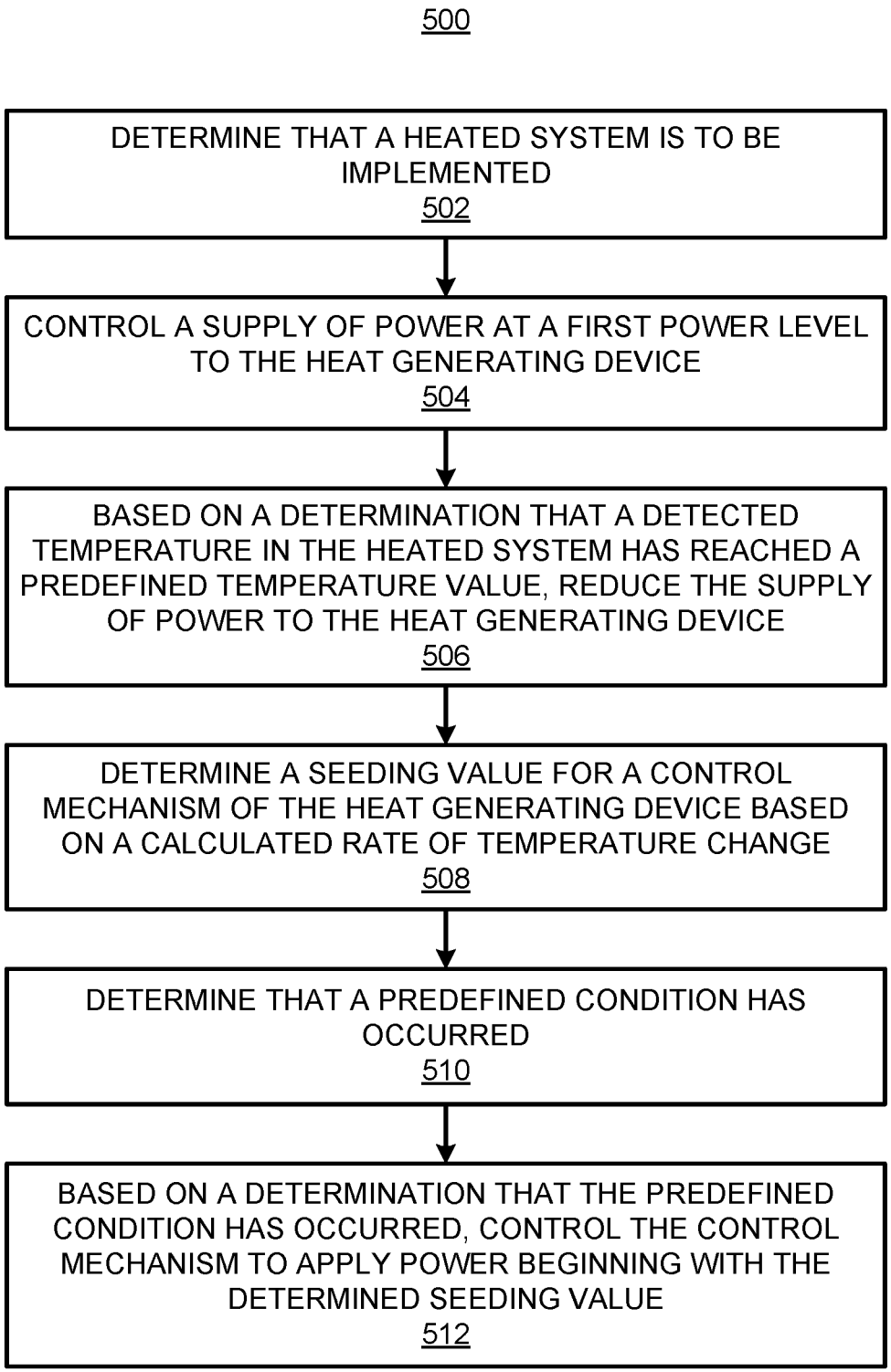
FIGS. 5 and 6, respectively, depict flow diagrams of example methods for controlling the temperature of a heated system.
Figure 6:
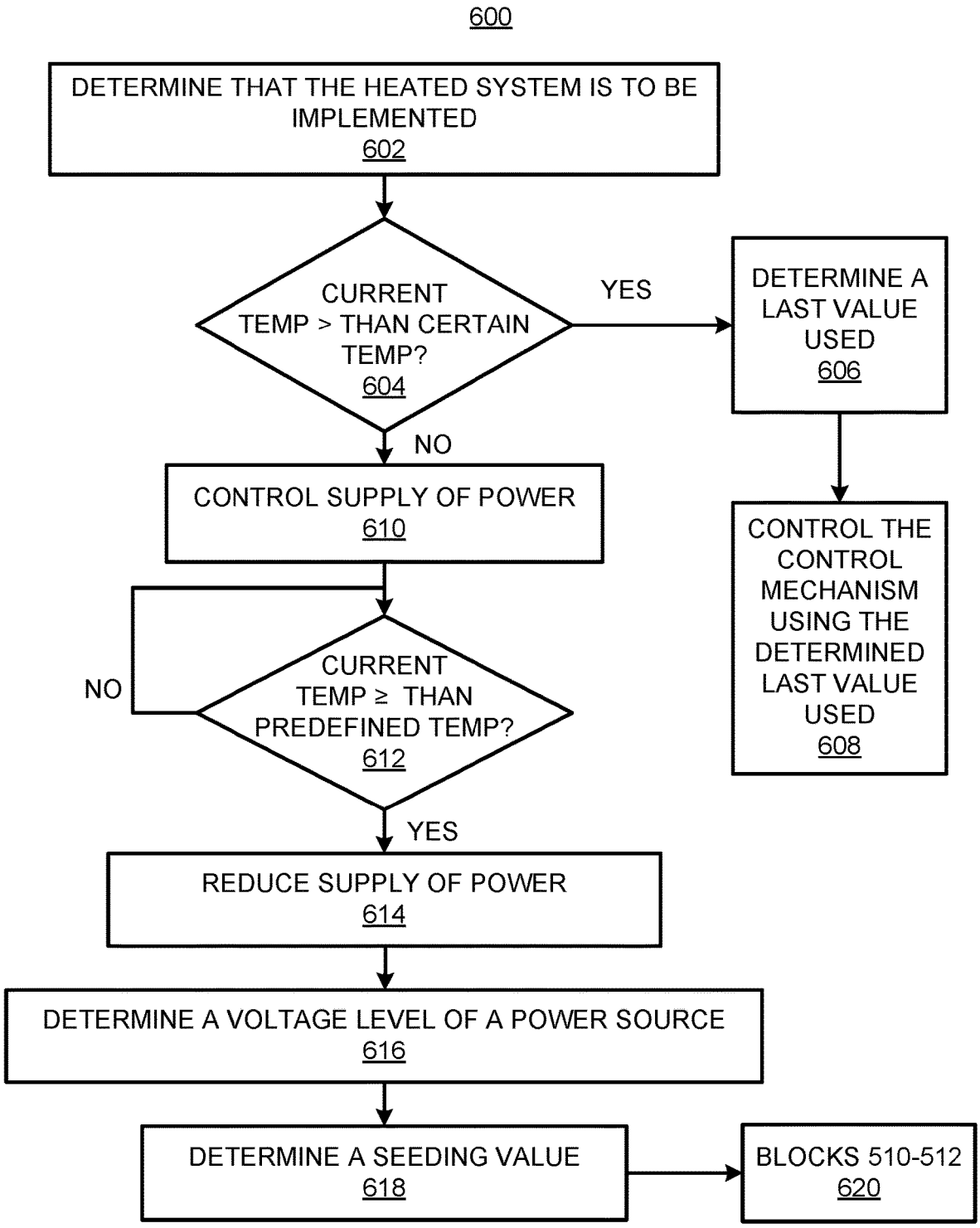

Various manners in which the controller 110 may operate are discussed in greater detail with respect to the methods 500 and 600 depicted in FIGS. 5 and 6. Particularly, FIGS. 5 and 6, respectively, depict flow diagrams of example methods 500 and 600 for controlling the temperature of a heated system 100. It should be understood that the methods 500 and 600 respectively depicted in FIGS. 5 and 6 may include additional operations and that some of the operations described therein may be removed and/or modified without departing from the scopes of the methods 500 and 600. The descriptions of the methods 500 and 600 are made with reference to the features depicted in FIGS. 1-4 for purposes of illustration.

With reference first to FIG. 5, at block 502, the controller 110 may determine that the heated system 100 is to be implemented. That is, the controller 110 may determine that the heated system 100 is to be implemented to apply heat to an object, e.g., a sheet or multiple sheets of media 202. As discussed herein, the heated system 100 may include a heat generating device 102 and may be associated with, e.g., assigned to, set to, etc., a setpoint temperature 306.

At block 504, the controller 110 may control a supply of power at a first power level to the heat generating device 102. The controller 110 may cause the heat generating device 102 to be supplied with power at the first power level to ramp up the temperature in the heated system 100 to the setpoint temperature 306. The first power level may be a maximum power level (or equivalently, a full power level) that the heat generating device 102 may receive and/or that a power source may supply to the heat generating device 102. As a result, the controller 110 may cause the heat generating device 102 to ramp up the temperature in the heated system 100 to the setpoint temperature 306 as soon as possible following the determination that the heated system 100 is to be implemented.

At block 506, based on a determination that a detected temperature in the heated system 100 has reached a predefined temperature value 304 that is below the setpoint temperature 306, the controller 110 may reduce the supply of power to the heat generating device 102. As discussed herein, the predefined temperature value 304 may be below the setpoint temperature 306 by a certain amount, in which the certain amount may be based on a temperature increase that may be predicted to occur in the heated system 100 following deactivation of the heat generating device 102. Thus, for instance, by reducing the power supply to the heat generating device 102 prior to the temperature in the heated system 100 reaching the setpoint temperature, the temperature in the heated system 100 may be prevented from overshooting the setpoint temperature 306.

At block 508, the controller 110 may determine a seeding value for a control mechanism 106 of the heat generating device 102 based on a calculated rate of temperature change (dT/dt) during the supply of power at the first power level to the heat generating device 102. As discussed herein, the rate of temperature change may be calculated for a certain period of time immediately prior to the stoppage of the supply of power to the heat generating device 102 at the first power level. In addition, the controller 110 may determine the seeding value for the control mechanism 106 from the calculated rate of temperature change as also discussed herein.

At block 510, the controller 110 may determine that a predefined condition has occurred. The predefined condition may be, for instance, an expiration of a maximum wait time, a condition that is based on the rate of temperature change, etc., as discussed herein.

At block 512, based on the determination that the predefined condition has occurred, the controller 110 may control the control mechanism 106 to apply power to the heat generating device 102 beginning with the determined seeding value. As discussed herein, the control mechanism 106 may be a feedback controller, such as a PID controller, and the seeding value may be an initial value that the control mechanism 106 may use to control the delivery of power to the heat generating device 102 to maintain the temperature in the heated system 100 at or near the setpoint temperature 306 following conclusion of the ramp up to the setpoint temperature 306.

Turning now to FIG. 6, at block 602, the controller 110 may determine that the heated system 100 is to be implemented. At block 604, the controller 110 may determine whether a current detected temperature is higher than a certain temperature, in which the certain temperature is lower than the predefined temperature value 304. By way of example, the certain temperature may be around 10° C. and around 20° C. below the setpoint temperature 306.

Based on a determination that the current detected temperature is higher than the certain temperature, the controller 110 may determine a last value used for the heat generating device 102 in a previous job as indicated at block 606. That is, the controller 110 may determine the last value that the control mechanism 106 used in controlling the heat generating device 102 during the most recent prior heating job. By way of particular example in which the control mechanism 106 is a PID controller, the last value may be the last PWM value used by the PID controller to control the heat generating device 102 prior to terminating the most recent prior heating job.

At block 608, the controller 110 may control the control mechanism to apply power to the heat generating device 102 beginning with the determined last value. In this regard, instead of ramping up the heat generating device 102 using a full power level, the heat generating device 102 may be supplied a lower amount of power at the start of a heating operation. Particularly, for instance, the heat generating device 102 may be supplied power at an appropriate level to maintain the temperature in the heated system 100 at or near the setpoint temperature 306 with a minimized number of corrections.

However, based on a determination that the current detected temperature is lower than the certain temperature, the controller 110 may control the supply of power to the heat generating device at the first power level as indicated at block 610. Block 610 may be similar to block 504 in FIG. 5.

At block 612, the controller 110 may determine whether a currently detected temperature is equal to or greater than the predefined temperature value 304. That is, for instance, the controller 110 may continuously or at intervals receive, from the temperature sensor 104, detected temperatures of the heated system 100. The controller 110 may store the received temperatures and may determine whether the current detected temperature has reached the predefined temperature value 304. In addition, the controller 110 may continue to track the current temperature and to compare the current temperature with the predefined temperature value 304.

At block 614, based on a determination that a detected temperature in the heated system 100 has reached a predefined temperature value 304 that is below the setpoint temperature 306, the controller 110 may reduce the supply of power to the heat generating device 102. For instance, the controller 110 may turn off the supply of power to the heat generating device 102.

At block 616, the controller 110 may determine a voltage level of a power source for the heat generating device 102. The voltage level may vary, for instance, in different countries. In addition, at block 618, the controller 110 may determine the seeding value for the heat generating device 102 based on the calculated rate of change and the determined voltage level.

At block 620, the controller 110 may determine that the predefined condition has occurred and based on the determination that the predefined condition has occurred, the controller 110 may control the control mechanism 106 to apply power to the heat generating device 102 beginning with the determined seeding value. In other words, the controller 110 may execute operations similar to those discussed above with respect to blocks 510-512 in FIG. 5.

Some or all of the operations set forth in the methods 500 and 600 may be included as utilities, programs, or subprograms, in any desired computer accessible medium. In addition, the methods 500 and 600 may be embodied by computer programs, which may exist in a variety of forms both active and inactive. For example, they may exist as machine readable instructions, including source code, object code, executable code or other formats. Any of the above may be embodied on a non-transitory machine readable medium.

Examples of non-transitory, machine readable media include computer system RAM, ROM, EPROM, EEPROM, and magnetic or optical disks or tapes. It is therefore to be understood that any electronic device capable of executing the above-described functions may perform those functions enumerated above.

Figure 7:
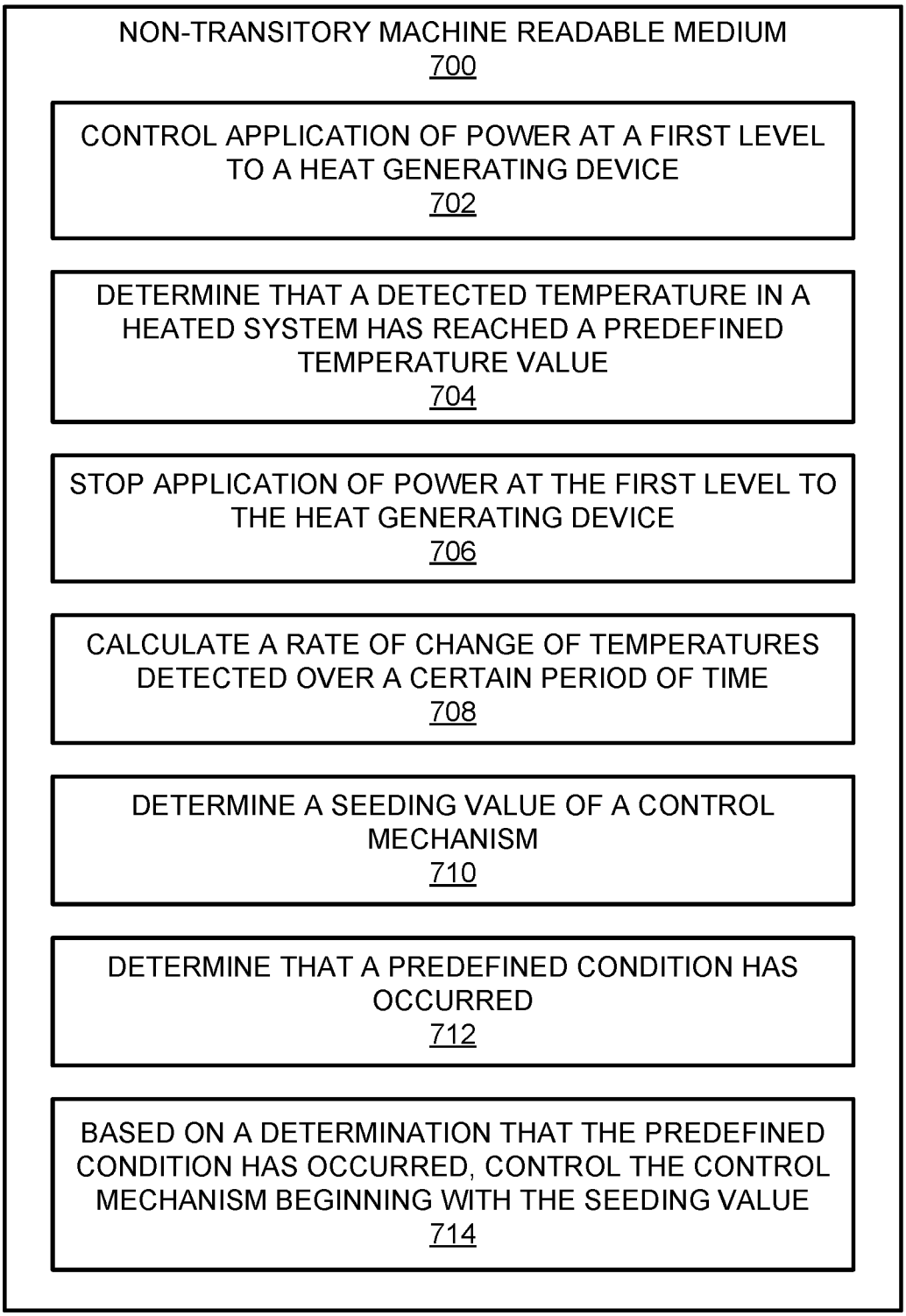
FIG. 7 shows an example non-transitory machine readable medium for controlling the temperature of a heated system.

Turning now to FIG. 7, there is shown an example non-transitory machine readable medium 700 for controlling the temperature of a heated system 100. The machine readable medium 700 may be an electronic, magnetic, optical, or other physical storage device that contains or stores executable instructions. The machine readable medium 700 may be, for example, Random Access memory (RAM), an Electrically Erasable Programmable Read-Only Memory (EEPROM), a storage device, an optical disc, and the like.

The non-transitory machine readable storage medium 700 may have stored thereon machine readable instructions 702-714 that a controller, e.g., the controller 110 may execute. The machine readable instructions 702 may cause the controller 110 to control application of power at a first level to a heat generating device 102. The machine readable instructions 704 may cause the controller 110 to determine that a detected temperature in a heated system 100 has reached a predefined temperature value 304 that is below a setpoint temperature 306 for the heated system 100. The machine readable instructions 706 may cause the controller 110 to stop application of power at the first level to the heat generating device 102 based on the determination. The machine readable instructions 708 may cause the controller 110 to calculate a rate of change of temperatures detected over a certain period of time prior to the application of power at the first level to the heat generating device 102 being stopped. The machine readable instructions 710 may cause the controller 110 to determine, based on the calculated rate of change, a seeding value for a control mechanism 106 that controls delivery of power to the heat generating device 102 to maintain the temperature at or near the setpoint temperature 306 following a ramp up period. The machine readable instructions 712 may cause the controller 110 to determine that a predefined condition has occurred. The machine readable instructions 714 may cause the controller 110 to, based on the determination that the predefined condition has occurred, control the control mechanism 106 to control delivery of power to the heat generating device 102 beginning with the determined seeding value.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A heated system comprising:

a heat generating device;

a temperature sensor to detect temperature in the heated system; and a controller to:

control an application of power to the heat generating device;

determine that the temperature in the heated system has reached a predefined temperature value that is below a setpoint temperature for the heated system;

stop the application of power to the heat generating device upon a determination that the temperature in the heated system has reached the predefined temperature value; and after the application of power to the heat generating device being stopped and the temperature in the heated system continuing to rise to the setpoint temperature, control a feedback device to maintain the temperature in the heated system at the setpoint temperature, wherein the controller is to determine the predefined temperature value based on a calculated rate of change of temperatures detected by the temperature sensor over a predefined period of time prior to the application of power to the heat generating device being stopped.

2. The heated system of claim 1, wherein the controller is further to:

determine whether a current detected temperature is higher than a certain temperature, the certain temperature being lower than the predefined temperature value; and based on a determination that the current detected temperature is lower than the certain temperature, initiate the application of power to the heat generating device.

3. The heated system of claim 2, wherein the controller is further to:

based on the determination that the current detected temperature is higher than the certain temperature, determine a last value used for the heat generating device in a previous job; and control a control mechanism to apply power to the heat generating device beginning with the determined last value.

4. The heated system of claim 1, wherein the feedback device is to vary the application of power to the heat generating device to maintain the temperature in the heated system within a predetermined temperature range.

5. A heated system comprising:

a heat generating device;

a temperature sensor to detect temperature in the heated system; and a controller to:

control an application of power to the heat generating device;

determine that the temperature in the heated system has reached a predefined temperature value that is below a setpoint temperature for the heated system;

stop the application of power to the heat generating device upon a determination that the temperature in the heated system has reached the predefined temperature value; and after the application of power to the heat generating device being stopped and the temperature in the heated system continuing to rise to the setpoint temperature, control a feedback device to maintain the temperature in the heated system at the setpoint temperature, wherein, to control the feedback device to maintain the temperature in the heated system at the setpoint temperature, the controller is to:

store temperatures detected by the temperature sensor over time;

calculate a rate of change of the stored temperatures corresponding to a predefined period of time prior to the application of power to the heat generating device being stopped;

based on the calculated rate of change, determine a seeding value for a control mechanism of the heat generating device;

determine that a predefined condition has occurred; and based on the determination that the predefined condition has occurred, control the control mechanism to apply power to the heat generating device beginning with the determined seeding value.

6. The heated system of claim 5, wherein the predefined condition comprises:

expiration of a maximum wait time;

a rate of temperature change going negative prior to the detected temperature reaching the setpoint temperature; or a current detected temperature exceeding the setpoint temperature and following the rate of temperature change going negative or the detected temperature falling below a threshold temperature.

7. The heated system of claim 6, wherein the controller is to determine the maximum wait time as a function of the calculated rate of change.

8. The heated system of claim 5, wherein the controller is further to:

determine a voltage level of a power source for the heat generating device; and determine the predefined temperature value based on the calculated rate of change and the determined voltage level.

9. A method comprising:

determining that a heated system is to be implemented, the heated system including a heat generating device and being associated with a setpoint temperature;

controlling a supply of power at a first power level to the heat generating device;

based on a determination that a detected temperature in the heated system has reached a predefined temperature value that is below the setpoint temperature, reducing the supply of power to the heat generating device;

determining a seeding value for a control mechanism of the heat generating device based on a calculated rate of temperature change during the supply of power at the first power level to the heat generating device;

determining that a predefined condition has occurred; and based on the determination that the predefined condition has occurred, controlling the control mechanism to apply power to the heat generating device beginning with the determined seeding value.

10. The method of claim 9, further comprising:

prior to controlling the supply of power at the first power level, determining whether a current detected temperature is higher than a certain temperature, the certain temperature being lower than the predefined temperature value; and based on a determination that the current detected temperature is lower than the certain temperature, supplying power to the heat generating device at the first power level.

11. The method of claim 10, further comprising:

based on a determination that the current detected temperature is higher than the certain temperature, determining a last value used for the heat generating device in a previous job; and controlling the control mechanism to apply power to the heat generating device beginning with the determined last value.

12. The method of claim 10, further comprising:

determining a voltage level of a power source for the heat generating device; and determining the seeding value for the heat generating device based on the calculated rate of change and the determined voltage level.

13. A non-transitory machine readable medium on which is stored machine readable instructions that when executed by a controller, cause the controller to:

control application of power at a first level to a heat generating device;

determine that a detected temperature in a heated system has reached a predefined temperature value that is below a setpoint temperature for the heated system;

stop application of power at the first level to the heat generating device based on a determination that the detected temperature has reached the predefined temperature value;

calculate a rate of change of temperatures detected over a certain period of time prior to the application of power at the first level to the heat generating device being stopped;

determine, based on the calculated rate of change, a seeding value for a control mechanism that controls delivery of power to the heat generating device;

determine that a predefined condition has occurred; and based on a determination that the predefined condition has occurred, control the control mechanism to control delivery of power to the heat generating device beginning with the determined seeding value.

14. The non-transitory machine readable medium of claim 13, wherein the predefined condition comprises:

expiration of a maximum wait time;

a rate of temperature change going negative prior to the detected temperature reaching the setpoint temperature; or a current detected temperature exceeding the setpoint temperature and following the rate of temperature change going negative or the detected temperature falling below a threshold temperature.

* * * * *